US011211713B2

(12) United States Patent
Loutridis et al.

(10) Patent No.: US 11,211,713 B2
(45) Date of Patent: Dec. 28, 2021

(54) ANTENNA SUITABLE TO BE INTEGRATED IN A PRINTED CIRCUIT BOARD, PRINTED CIRCUIT BOARD PROVIDED WITH SUCH AN ANTENNA

(71) Applicant: THE ANTENNA COMPANY INTERNATIONAL N.V., Willemstad (CW)

(72) Inventors: Avraam Loutridis, Eindhoven (NL); Carlos Moreno De Jong Van Coevorden, Eindhoven (NL); János Sófalvi, Eindhoven (NL); Diego Caratelli, Eersel (NL)

(73) Assignee: THE ANTENNA COMPANY INTERNATIONAL N.V., Willlemstad (CW)

( * ) Notice: Subject to any disclaimer, the term of this patent is extended or adjusted under 35 U.S.C. 154(b) by 0 days.

(21) Appl. No.: 16/643,385

(22) PCT Filed: Aug. 30, 2018

(86) PCT No.: PCT/NL2018/050560
§ 371 (c)(1),
(2) Date: Feb. 28, 2020

(87) PCT Pub. No.: WO2019/045563
PCT Pub. Date: Mar. 7, 2019

(65) Prior Publication Data

US 2020/0350689 A1 Nov. 5, 2020

(30) Foreign Application Priority Data

Aug. 31, 2017 (GR) ..... 20170100395
Aug. 31, 2017 (NL) ..... 2019472

(51) Int. Cl.
*H01Q 13/10* (2006.01)
*H01Q 5/10* (2015.01)
(Continued)

(52) U.S. Cl.
CPC ..... *H01Q 13/106* (2013.01); *H01Q 5/10* (2015.01); *H01Q 5/357* (2015.01);
(Continued)

(58) Field of Classification Search
CPC ..... H01Q 1/38; H01Q 13/10; H01Q 13/106; H01Q 1/243; H01Q 13/18; H01Q 5/10; H01Q 13/085; H01Q 13/16; H01Q 5/357
See application file for complete search history.

(56) References Cited

U.S. PATENT DOCUMENTS 3,228,030 A * 1/1966 Moore ..... H01Q 1/273 343/746
5,914,693 A 6/1999 Takei et al.
(Continued)

FOREIGN PATENT DOCUMENTS

EP 0991135 A1 4/2000

*Primary Examiner* — Vibol Tan
(74) *Attorney, Agent, or Firm* — Nath, Goldberg & Meyer; Joshua B. Goldberg

(57) ABSTRACT

Antenna suitable to be integrated in a printed circuit board, which is an electromagnetically coupled antenna that comprises:
- a body of dielectric material of a substantially planar design having a bottom side and top side;
- a bottom metallized layer on the bottom side of the body, which layer is provided with a slot;
- a top metallized layer on the top side of the body, which layer is provided with a T-shaped slot;
- wherein both the above slots, as well as the top and bottom metallized layer surrounding the slots, are provided on symmetrically opposite sides of the body;
- wherein electrically conductive strands are provided in the body, which strands extend substantially vertically (Continued)

from the bottom side to the top side, and electrically connect the bottom metallized layer with the top metallized layer;

wherein the strands are disposed in such a way as to collectively form a row that delimits an inner volume of the body;

wherein a feeding line of electrically conductive material is provided inside the body, the feeding line extending in a plane between the bottom side and the top side, wherein the feeding line has a distal section extending within the inner volume of the body delimited by the strands, which distal section has a curled shape in the plane in which it extends.

25 Claims, 7 Drawing Sheets

(51) Int. Cl.
*H01Q 13/16* (2006.01)
*H01Q 13/18* (2006.01)
*H01Q 13/08* (2006.01)
*H01Q 5/357* (2015.01)

(52) U.S. Cl.
CPC ..... *H01Q 13/085* (2013.01); *H01Q 13/10* (2013.01); *H01Q 13/16* (2013.01); *H01Q 13/18* (2013.01)

(56) References Cited

U.S. PATENT DOCUMENTS

| | | | | |
|---|---|---|---|---|
| 9,865,935 | B2 * | 1/2018 | Miraftab | H01Q 21/005 |
| 10,673,135 | B2 * | 6/2020 | Yu | H01Q 13/085 |
| 2004/0004576 | A1 | 1/2004 | Anderson | |
| 2008/0284670 | A1 | 11/2008 | Kanno et al. | |
| 2013/0169498 | A1 * | 7/2013 | Chen | H01Q 13/10 343/770 |
| 2017/0084971 | A1 * | 3/2017 | Kildal | H01P 3/12 |
| 2017/0229763 | A1 * | 8/2017 | Barak | H01Q 1/38 |

* cited by examiner

ANTENNA SUITABLE TO BE INTEGRATED IN A PRINTED CIRCUIT BOARD, PRINTED CIRCUIT BOARD PROVIDED WITH SUCH AN ANTENNA

This is a National Phase Application filed under 35 U.S.C. 371 as a national stage of PCT/NL2018/050560, filed Aug. 30, 2018, and claims priority from Netherlands Application No. 2019472, filed Aug. 31, 2017, and Greek Application No. 20170100395, filed Aug. 31, 2017, the content of each of which is hereby incorporated by reference in its entirety.

The present invention relates to an antenna suitable to be integrated in a printed circuit board, which is an electromagnetically coupled antenna that comprises:

- a body of dielectric material of a substantially planar design having a bottom side and top side;
- a bottom metallized layer on the bottom side of the body;
- a top metallized layer on the top side of the body;
- wherein the top and bottom metallized layer are provided on symmetrically opposite sides of the body;
- wherein a feeding line of electrically conductive material is provided inside the body,
- the feeding line extending in a plane between the bottom side and the top side.

Such electromagnetically coupled antennas have an interesting, basic design to consider these for integration in a printed circuit board (PCB) for routers and top boxes that may be used in Wi-Fi applications. In order to achieve the most feasible integration of the antenna in a PCB board, a general urge exists in the field to miniaturize the electromagnetically coupled antenna as much as possible, while retaining sufficient radiation properties.

Apart from a reduced size of the antenna making integration in a PCB more feasible, any successful step in miniaturization may contribute to a further reduced coupling effect, and more uniform radiation patterns. Furthermore, such may result in higher throughput levels.

In order to accomplish a further miniaturization of the electromagnetically coupled antenna, it is a requisite that the antenna shall be improved in regard of at least one of two crucial properties:

- fractional bandwidth (FBW), which is defined as the bandwidth range in which less than 10 dB return loss occurs, divided by the central frequency;
- average magnitude of the input reflection coefficient (IRC); that is a measure for the loss of power that is not accepted at the input terminals of the antenna.

As a general rule, a larger FBW value results in an improved antenna performance in regard of its margins. Conversely, a reduction of the IRC value is required to achieve an improved antenna performance. If one value, or preferably both values are improved, the antenna as a whole may be dimensioned smaller, thus achieving a further miniaturization.

The general objective of improving the antenna by the above two properties, can be quantified by the objective function (OF) which is the ratio of FBW divided by IRC. Accordingly, a larger OF indicates a better performance of the antenna. The OF value shall be used as a yard stick in this description to determine to what extent the antenna performance is improved.

The present invention meets the above general objective, by the provision of:

An antenna suitable to be integrated in a printed circuit board, which is an electromagnetically coupled antenna that comprises:

- a body of dielectric material of a substantially planar design having a bottom side and top side;
- a bottom metallized layer on the bottom side of the body, which layer is provided with a slot;
- a top metallized layer on the top side of the body, which layer is provided with a T-shaped slot;
- wherein both the above slots, as well as the top and bottom metallized layer surrounding the slots, are provided on symmetrically opposite sides of the body;
- wherein electrically conductive strands are provided in the body, which strands extend substantially vertically from the bottom side to the top side, and electrically connect the bottom metallized layer with the top metallized layer;
- wherein the strands are disposed in such a way as to collectively form a row that delimits an inner volume of the body;
- wherein a feeding line of electrically conductive material is provided inside the body,
- the feeding line extending in a plane between the bottom side and the top side,
- wherein the feeding line has a distal section extending within the inner volume of the body delimited by the strands, which distal section has a curled shape in the plane in which it extends.

In regard of the above definition, the following terms are further explained:

- the strands are provided in the form of thin pillars of electrically conductive material, and they are also referred to in jargon as 'vias'.
- the curled shape of the distal section of the feeding line, may also be referred to as a bent or meander shape.
- The feeding line has a proximal section which is connectable to an appropriate RF chain in order to effectively have the antenna function as a transceiver.
- Within the antenna, the body of dielectric material functions as a dielectric substrate for the antenna, and it may alternatively be referred to as such.

It was found by the inventors that the above antenna allows for a further miniaturization, because the FBW value is raised by its novel design. Furthermore, the IRC value is reduced by the invention.

It is preferred that the antenna according to the invention is further provided with an additional body of dielectric material which covers the T-shaped slot in the top metallized layer. The additional body may be flat and thin, and hence have the form of a chip, preferably made out of polymer or glass. The additional body thus functions, also, as dielectric load of the antenna.

It was found that the advantageous effects of the antenna could be further enhanced by virtue of the additional body.

It is further preferred in the antenna according to the invention, that the contour of the T-shaped slot in the top metallized layer is composed of two longitudinal slots of which a first slot forms a horizontally oriented slot of which the middle part is connected to the top end of a second slot which forms a vertically oriented slot.

The T-shaped slot is thus not limited to the classical capital T form or contour, but is more generally based on two connecting longitudinal slots of which the longitudinal axis have an orthogonal orientation towards each other. The longitudinal slots may be rectangular slots, rounded forms (e.g. elliptic forms), or more intricate versions thereof (e.g. multi-lobed and/or multi-cornered forms).

In the context of the invention, the term horizontally and vertically are merely used as relative terms in order to express the relative orientation, which is orthogonal to each other. The terms should not be understood as having an additional, or absolute meaning.

Preferably in the antenna according to the invention, the distance between adjacent strands in a row is in the range of 1 up to 2 times the thickness of a single strand.

A practically appropriate thickness of the body of dielectric material may lie in the range of 0.6 to 1.0 mm, for instance about 0.8 mm.

According to a first particular aspect of the invention, the antenna is suitable to be used in the WiFi frequency range of 4.9 GHz up to 6 GHz. This range is also hereafter referred to as a 5 GHz frequency band, and the antenna as a '5G antenna'.

The following, preferred features of the invention are in particular useful for that frequency range.

- the bottom metallized layer is provided with a slot having a rectangular, preferably square shape.
- the curled shape is an L-shape, so that the final part of the distal section of the feeding line is oriented substantially orthogonal to a proximal section of the feeding line.
- the above L-shape is of a rectangular design, which comprises two longitudinal sections having an orthogonal orientation.
- In the above rectangular design, the first longitudinal section comprises a proximal section of the feeding line, and the second longitudinal section comprises the end part of the distal section of the feeding line, wherein the length of the first longitudinal section (L1) is in the range of 2 to 4 times the length of the second longitudinal section (L2).

In addition, the next described, preferred features of the invention relating to the T-shaped slot, are in particular useful in the frequency range above:

- The T-shaped slot comprising a first, horizontally oriented slot having a cross-directional width halfway its length, denoted as Hw, in a range of 0.60 up to 0.90 mm (preferably 0.68 mm or 0.84 mm)
- The T-shaped slot comprising a second, vertically oriented slot having a cross-directional width halfway its length, denoted as Vw, in a range of 3.00 mm up to 4.00 mm (preferably 3.88 mm or 3.38 mm)

Further it is preferred in the antenna according to the invention, that the contour of the T-shaped slot in the top metallized layer is composed of two slots of which a first slot forms a horizontally oriented slot of which the middle part is connected to the top end of a second slot which forms a vertically oriented slot,

- wherein the contours of the first and second slot are each defined by the following formula:

$$r_i(\varphi) = \left(\left|\frac{1}{a_i}\cos\frac{m_i}{4}\varphi\right|^{n_{2_i}} + \left|\frac{1}{b_i}\sin\frac{m_i}{4}\varphi\right|^{n_{2_i}}\right)^{-1/n_{1_i}}$$

wherein:

- the letter i is an indicator for the formula defining either a first slot (i=1) or a second slot (i=2),
- n2=n1
- ρd(φ) is a curve located in the XY-plane,
- φ∈[0,2π) is the angular coordinate
- ai and bi are scaling factors determining the size of the shape.

In this context of defining the contours by formula, the contour of the second, vertically oriented slot may be a truncated form of the slot as defined by the formula. Accordingly, the contour of the second slot is a segment of the contour as defined by the formula. This truncation is done for dimensional reasons, in order to adapt the vertical length of the second slot.

The formula above is also known as a 'superformula' and the contours defined by it as 'supershapes', the underlying theory has been developed by J. Gielis, and has been described in several scientific articles as well as in U.S. Pat. No. 7,620,527.

In order to compose a T-shape with the form of a classical capital T, the T-shaped slot is composed of the contours according to the above formula,

- wherein the contours of the first and second slot are each defined by the additional conditions:
- m1=m=4
- n1_i, n2_i, n3_i→∞

In particular, it is preferred that in the antenna which has a T-shaped slot composed of the contours according to the above formula, the following parameters are applied for i=1
- m1=6
- n1_1=38
- n3_1=19 for i=2
- m2=6
- n1_2=24
- n3_2=47.5 with
L2=3.15 mm
Hw=0.84
Vw=3.38
ai=1
bi=1

Such an antenna is referred to as having an optimal impedance matching (OIM) configuration.

Further in particular, it is preferred that in the antenna which has a T-shaped slot composed of the contours according to the above formula, the following parameters are applied for i=1
- m1=6
- n1_1=38
- n3_1=79 for i=2
- m2=6
- n1_2=24
- n3_2=47.5 with
L2=3.15 mm
Hw=0.84
Vw=3.38
ai=1
bi=1

Such an antenna is referred to as having an ultra-wideband (UWB) configuration.

For the antenna suitable in the 5 GHz frequency range, some preferred dimensions are:

- The T-shaped slot, and also the rectangular slot, both fit within a square area 7.5×7.5 mm.
- The additional body has a size of 7.5×7.5×2.5 mm (w×I×h).
- The feeding line of a rectangular L-shape, is characterized by:
  - L1 between 6 and 9 mm;
  - L2 between 2.5 and 3.5 mm;
- Width of the feeding line between 0.25 and 2.0 mm.

The width of the feeding line is optimized in order to achieve enhanced impedance matching characteristics to 50 Ohm of the antenna element across the entire frequency band of operation.

According to a second particular aspect of the invention, the antenna is suitable to be used in the WiFi frequency range between 2.4 and 2.5 GHz. This range is also hereafter referred to as a 2.4 GHz frequency band, and the antenna as a '2G antenna'.

The following, preferred features of the invention are in particular useful for that frequency range:

- the bottom metallized layer is provided with a T-shaped slot, which preferably is identical to the slot in the top metallized layer.
- the curled shape of the feeding line is a G-shape, preferably a rectangular G-shape which comprises four or five longitudinal sections of which consecutive sections have an orthogonal orientation.
- the feeding line comprises four or five longitudinal sections of which consecutive sections have an orthogonal orientation,
  - wherein the first longitudinal section comprises a proximal section of the feeding line, and the fourth or fifth longitudinal section constitutes the end part of the distal section of the feeding line,
  - wherein the length of the first longitudinal section (L1) is in the range of 2 to 4 times the length of the second longitudinal section (L2).

In regard of the feeding line of a G-shape, the following dimensions are preferred:

- The lengths L1, L2, L3, L4, L5 of the first, second, third, fourth, fifth longitudinal section are preferred:
- L1 in the range of 15 to 20 mm, e.g. 18 mm
- L2 in the range of 5 to 9 mm, e.g. 7.64 mm
- L3 in the range of 3 to 5 mm, e.g. 4.18 mm, L3=0.5*L2
- L4 in the range of 4 to 7 mm, e.g. 5.68 mm, L3<L4<L2
- L5 in the range of 0.25 to 2.0 mm, e.g. 0.66 mm, L5=0.15*L3.
- The feeding line has a width in the range of 0.25 to 2.0 mm, including preferred values of 0.68 and 0.80 mm.

The width of the feeding line is optimized in order to achieve enhanced impedance matching characteristics to 50 Ohm of the antenna element across the entire frequency band of operation.

In addition, the next described, preferred features of the invention relating to the T-shaped slot, are in particular useful in the frequency range of 2.4 GHz to 2.5 GHz:

- the T-shaped slot comprises a first, horizontally oriented slot having a cross-directional width halfway its length, denoted as Hw, in a range of 1.20 to 1.40 mm, e.g. 1.23 or 1.38 mm.
- the T-shaped slot comprises a second, vertically oriented slot having a cross-directional width halfway its length, denoted as Vw, in a range of 2.5-3.0 mm, e.g. 2.75 mm.

Further it is preferred in the antenna according to the invention, that the contour of the T-shaped slot in the top metallized layer is composed of two slots of which a first slot forms a horizontally oriented slot of which the middle part is connected to the top end of a second slot which forms a vertically oriented slot,

- wherein the contours of the first and second slot are each defined by the following formula:

$$r_i(\varphi) = \left(\left|\frac{1}{a_i}\cos\frac{m_i}{4}\varphi\right|^{n_{2_i}} + \left|\frac{1}{b_i}\sin\frac{m_i}{4}\varphi\right|^{n_{3_i}}\right)^{-1/n_{1_i}}$$

wherein:

- the letter i is an indicator for the formula defining either a first slot (i=1) or a second slot (i=2),
- ρd(φ) is a curve located in the XY-plane,
- φ∈[0,2π) is the angular coordinate,
- ai and bi are scaling factors determining the size of the shape.

In this context of defining the contours by formula, the contour of the second, vertically oriented slot may be a truncated form of the slot as defined by the formula. Accordingly, the contour of the second slot is a segment of the contour as defined by the formula. This truncation is done for dimensional reasons, in order to adapt the vertical length of the second slot.

The formula above is also known as a 'superformula' and the contours defined by it as 'supershapes', the underlying theory has been developed by J. Gielis, and has been described in several scientific articles as well as in U.S. Pat. No. 7,620,527.

In order to compose a T-shape with the form of a classical capital T, the T-shaped slot is composed of the contours according to the above formula, wherein the contours of the first and second slot are each defined by the additional conditions:

mi=4 n1_i, n2_i, n3_i→∞

In particular, it is preferred that in the antenna which has a T-shaped slot composed of the contours according to the above formula, the following parameters are applied:

for i=1 a1=0.5
b1=4.1
m1=4
n1_1=103
n2_1=33
n3_1=59 or i=2 a2 7.3
b2 3.7
m2=4
n1_2=33
n2_2=48
n3_2=49 with

Hw=1.23
Vw=2.76

Such an antenna is referred to as having an optimal impedance matching (OIM) configuration.

Further in particular, it is preferred that in the antenna which has a T-shaped slot composed of the contours according to the above formula, the following parameters are applied:

for i=1 a1=7.6
b1=3.8
m1=4
n1_1=89.8
n2_1=87
n3_1=88 for i=2 a2=7.7
b2=7.8
m2=4
n1_2=81.9
n2_2=82
n3_2=91 with

Hw=1.38

Vw=2.76

Such an antenna is referred to as having a broadband (BB) configuration.

For the antenna suitable in the 2.4-2.5 GHz frequency range, some preferred dimensions are:

The T-shaped slot fits within a rectangular area of 15×11 mm;

The additional body has a size of 15×11×3.0 mm (w×I×h).

In another aspect, the invention relates to a printed circuit board which is provided with an antenna according to the invention, wherein a part of the board, and preferably a part of the circumferential edge of the board, constitutes the body of dielectric material of the antenna.

The invention will be further elucidated by the appended figures in which.

Figure 1:
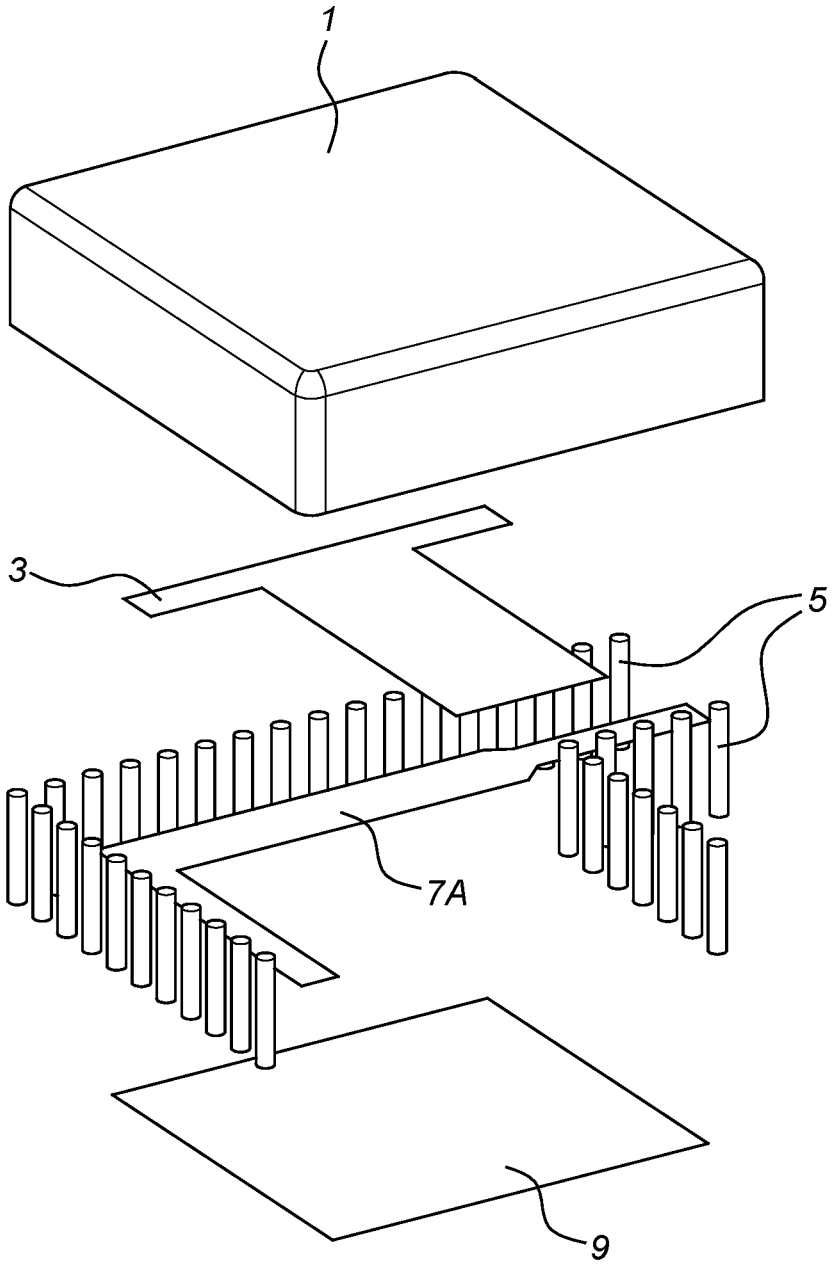
FIG. 1 shows an exploded view of constituting parts of a first preferred type of an antenna according to the invention.

FIG. 1 shows the following elements of a first preferred type of the antenna: An additional body in the form of a thin block or dielectric chip 1, a T-shaped slot 3 to be provided on the top metallized layer, strands of electro conductive material 5 that are positioned in rows that delimit an internal space, and a feeding line 7A of an L-shape of which the distal section extends within the internal space. Further, a rectangular slot 9 to be provided on the bottom metallized layer is shown.

This first preferred type of the antenna, is suitable to be used in the frequency range between 4.9 and 6.0 GHz, and may be referred to as 5G antenna.

Figure 2:
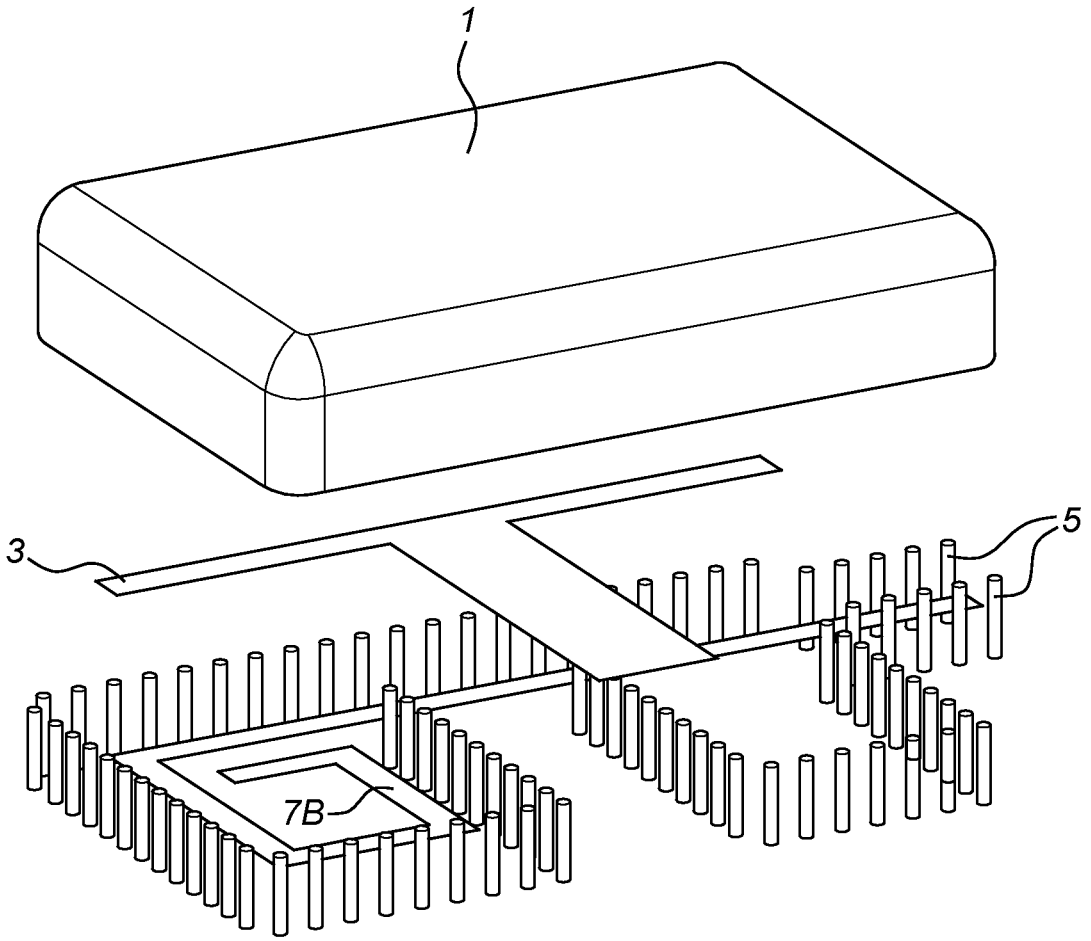
FIG. 2 shows an exploded view of constituting parts of a second preferred type of an antenna according to the invention.

FIG. 2 shows a second preferred type of the antenna, having similar elements as described for the first preferred type, which elements are indicated by the same numerals.

The second preferred type differs from the first, in that a slot to be provided on the bottom metallized layer is not shown, but is actually identical to the T-shaped slot 3. Further, the strands are positioned in a more intricate pattern, and the feeding line 7B is of a G-shape. The chosen dimensions of the second type antenna are also different over the first type.

This second preferred type of the antenna, is suitable to be used in the frequency range between 2.4 and 2.5 GHz, and may be referred to as 2G antenna.

Figure 3:
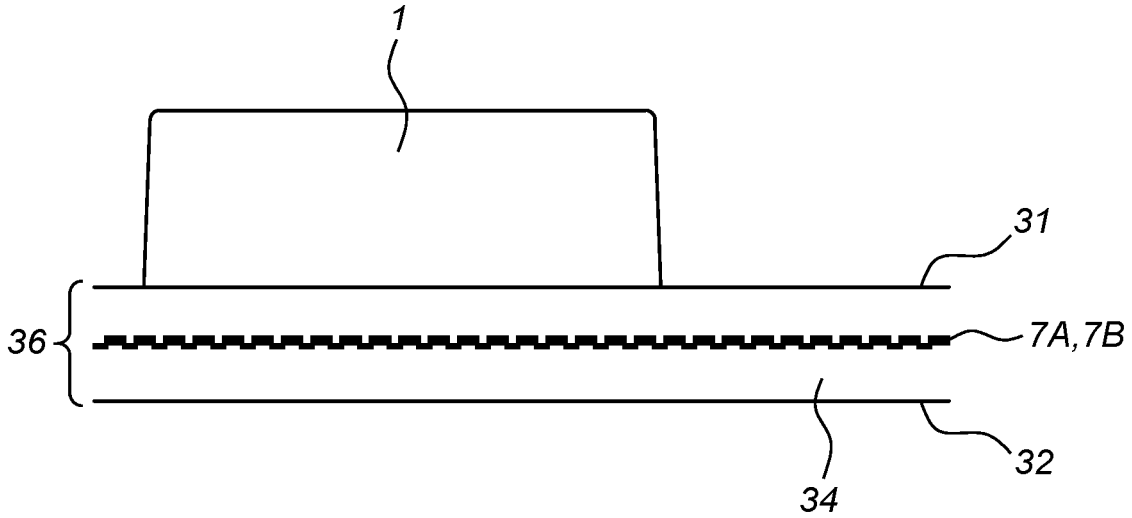
FIG. 3 shows schematically a cross-sectional view of the antenna, which is applicable to both preferred types of the antenna.

FIG. 3 shows in cross-section the general constitution that applies to both preferred types of the antenna, with

- a body 34 of dielectric material of a substantially planar design having a bottom side and top side;
- a bottom metallized layer 32 on the bottom side of the body, which layer is provided with a slot;
- a top metallized layer 31 on the top side of the body, which layer is provided with a T-shaped slot;
- wherein both the above slots, as well as the top and bottom metallized layer surrounding the slots, are provided on symmetrically opposite sides of the body;
- a feeding line 7A, 7B of electrically conductive material provided inside the body, the feeding line extending in a plane between the bottom side and the top side.

The whole assembly 36 constitutes an antenna according to the invention, which is complemented with an additional body 1 on the top side to further enhance the antenna characteristics.

In FIG. 3 the electrically conductive strands have been omitted to simplify the overview.

Figure 4:
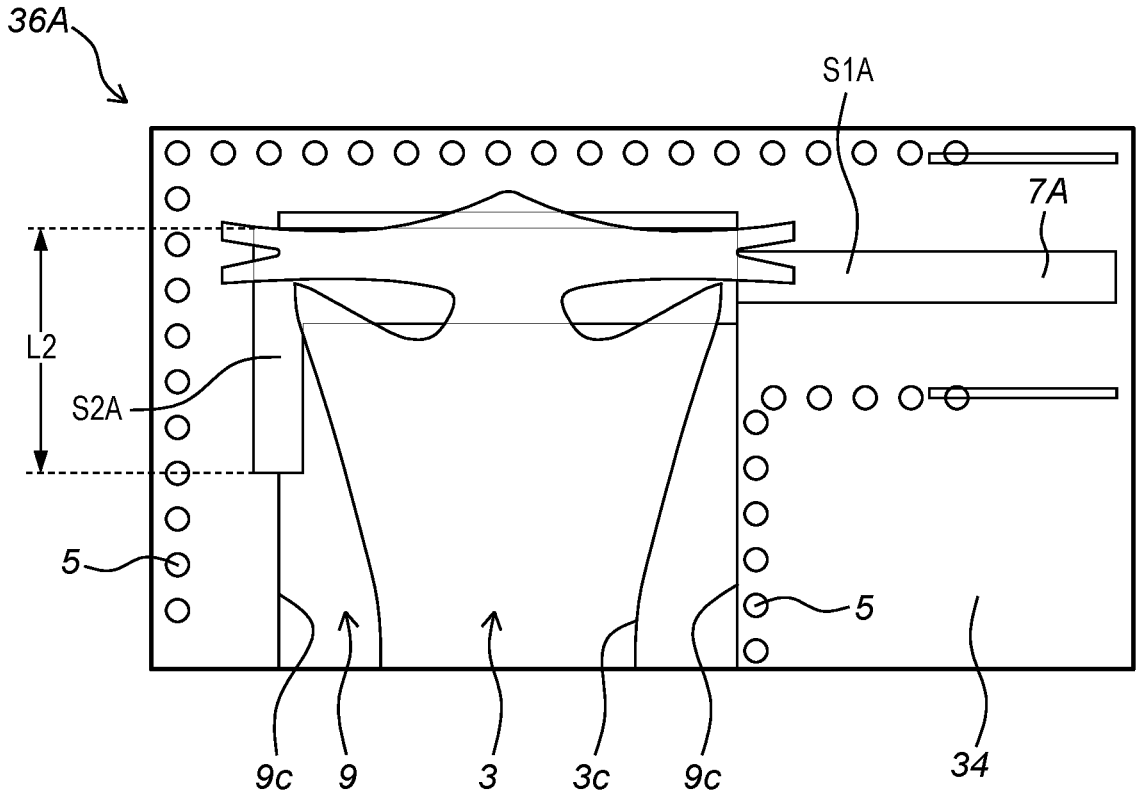
FIG. 4 shows a transparent top view of the first preferred type.

FIG. 4 shows a transparent top view of an antenna 36A of the first type, with a special modified T-shaped slot 3 on the top side metallized layer, and of a rectangular slot 9 on the bottom side metallized layer. The contours of both slots are indicated by 3*c* resp. 9*c*. The strands 5 are disposed in rows, delimiting an inner volume of the body 34 in which the feeding line 7A extends with its distal section that comprises the distal part of first longitudinal section s1A (depicted as the left side) and the second longitudinal section s2A. The proximal section of 7A (right side) is connectable to a not shown radio element (RF chain).

Figure 5:
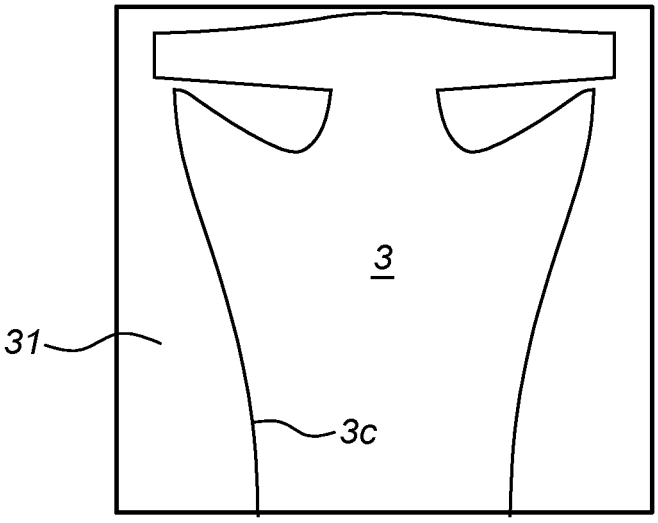
FIGS. 5 and 6 show two preferred T-shaped slots applicable to the first preferred type.

FIG. 5 shows a preferred T-shaped slot 3 delimited by a contour 3*c* and provided on the top metallized layer 31. This slot is suitable for the first preferred type, and is referred to as having an optimal impedance matching (OIM) configuration.

The contour of the T-shaped slot 3 in the top metallized layer is composed of two slots of which a first slot forms a horizontally oriented slot of which the middle part is connected to the top end of a second slot which forms a vertically oriented slot,

- wherein the contours of the first and second slot are each defined by the superformula according to appended claim 12 with the parameters of appended claim 13.

Figure 6:
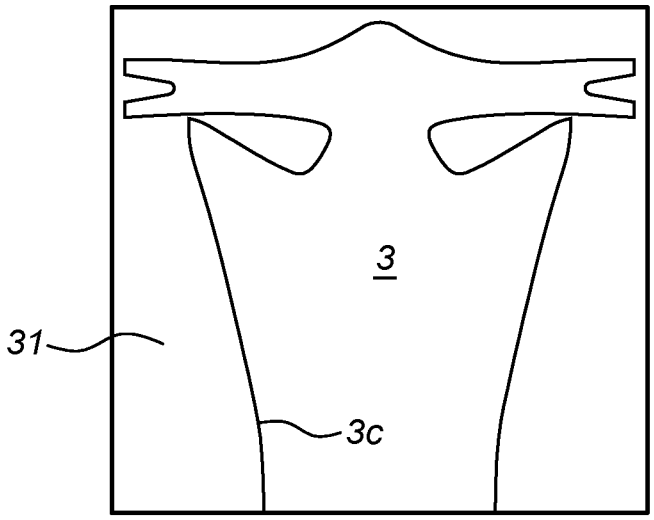

FIG. 6 shows an alternative, preferred T-shaped slot 3 delimited by a contour 3*c* and provided on the top metallized layer 31. Such a type of slot is referred to as having an ultra-wideband (UWB) configuration.

The contour of the T-shaped slot 3 in the top metallized layer is composed of two slots of which a first slot forms a horizontally oriented slot of which the middle part is connected to the top end of a second slot which forms a vertically oriented slot,

- wherein the contours of the first and second slot are each defined by the superformula according to appended claim 12 with the parameters of appended claim 14.

Figure 7:
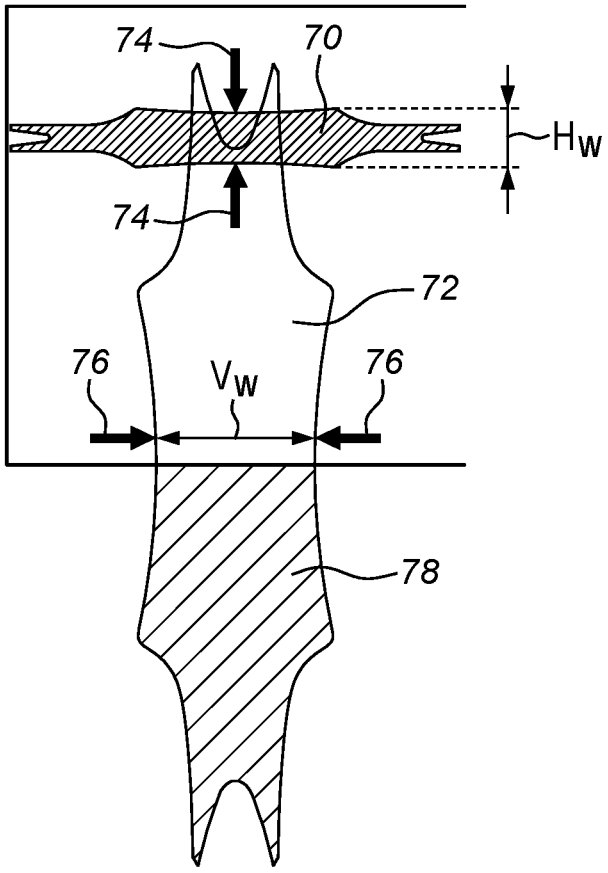
FIG. 7 shows how a preferred T-shaped slot is composed from two combined longitudinal slots.

FIG. 7 shows how the preferred T-shaped slot depicted in FIG. 6, is composed from two combined longitudinal slots 70 and 72, of which the first is horizontally oriented, and the second is vertically oriented. The vertical slot 72 is a truncated form of a complete longitudinal slot as defined by the formula and shown in the picture, and the lower half 78 (indicated by hatched lines) is not used. Arrows 74 indicate the first slot 70 having a cross-directional width halfway its length, denoted as Hw. Arrows 76 indicate the second slot 72 having a cross-directional width halfway its length (i.e. halfway the complete length without truncation), denoted as Vw.

Figure 8:
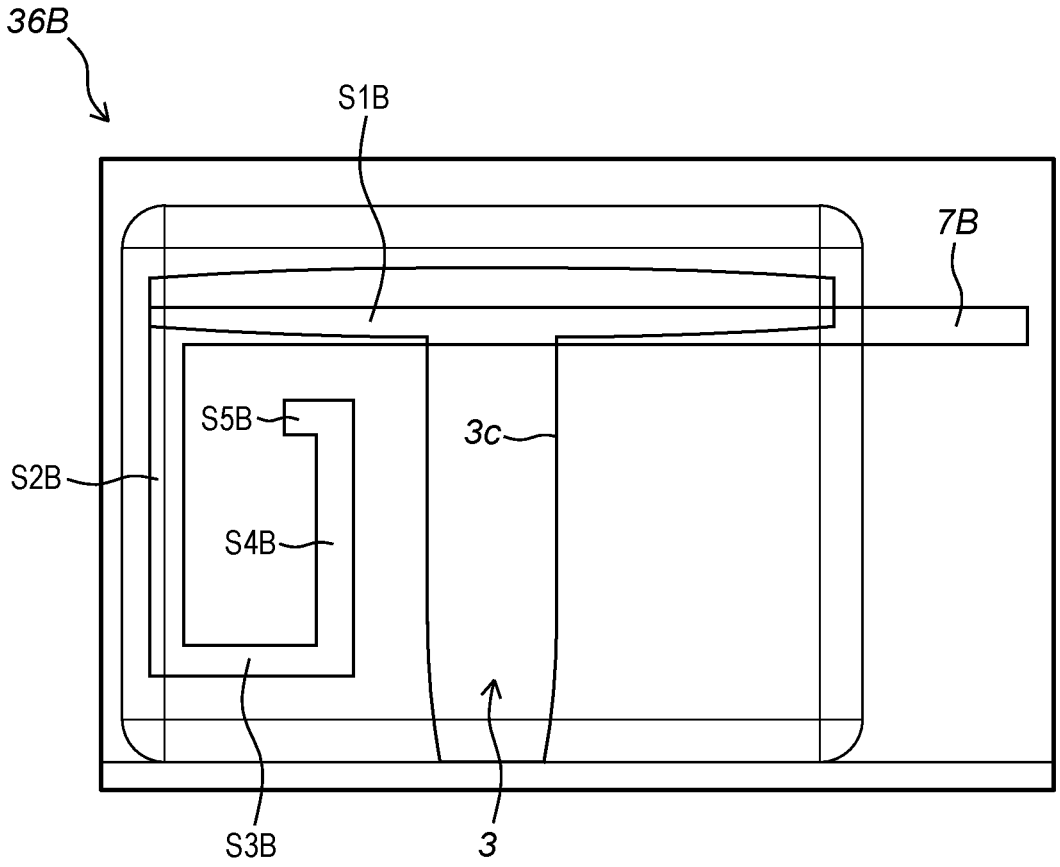
FIG. 8 shows a transparent top view of the second preferred type.

FIG. 8 shows a transparent top view of an antenna 36B of the second type, with a special T-shaped slot 3 on the top side metallized layer, of which the contour is indicated by 3*c*. The strands are omitted from this view, but their position correspond to FIG. 2. The feeding line 7B has a distal section (left side of picture) that curls into a G-shape, consisting of five consecutive longitudinal sections s1B, s2B, s3B, s4B and 25B, of which consecutive sections have an orthogonal orientation. The proximal section of 7B (right side) is connectable to a not shown radio element (RF chain).

Figure 9:
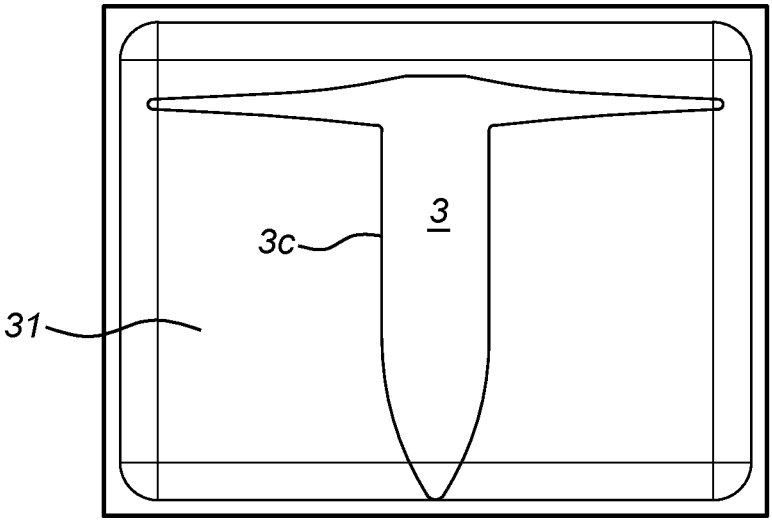
FIGS. 9, 10 and 11 show three preferred T-shaped slots applicable to the second preferred type.

FIG. 9 shows a preferred T-shaped slot 3 delimited by a contour 3*c* and provided on the top metallized layer 31. This slot is suitable for the second preferred type, and is referred to as having an optimal impedance matching (OIM) configuration.

The contour of the T-shaped slot 3 in the top metallized layer is composed of two slots of which a first slot forms a horizontally oriented slot of which the middle part is connected to the top end of a second slot which forms a vertically oriented slot, wherein the contours of the first and second slot are each defined by the superformula according to appended claim 22 with the parameters of appended claim 23.

Figure 10:
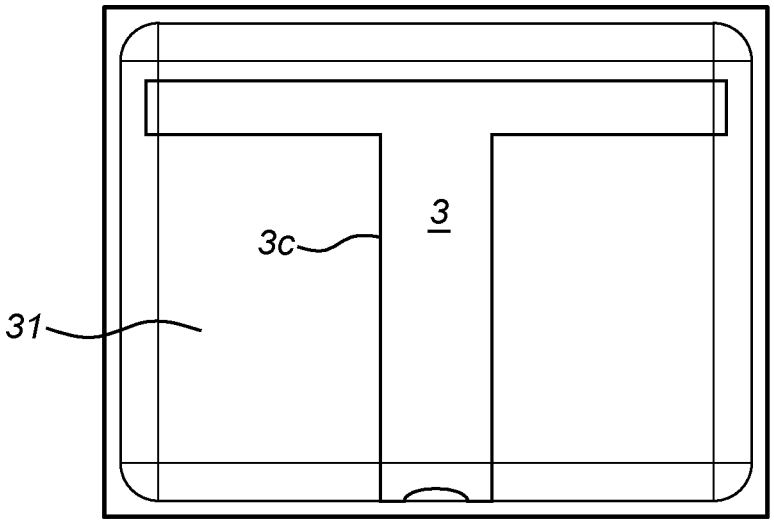

FIG. 10 shows an alternative, preferred T-shaped slot 3 delimited by a contour 3*c* and provided on the top metallized layer 31. Such a type of slot is referred to as having a broad-band (BB) configuration.

The contour of the T-shaped slot 3 in the top metallized layer is composed of two slots of which a first slot forms a horizontally oriented slot of which the middle part is connected to the top end of a second slot which forms a vertically oriented slot, wherein the contours of the first and second slot are each defined by the superformula according to appended claim 22 with the parameters of appended claim 24.

Figure 11:
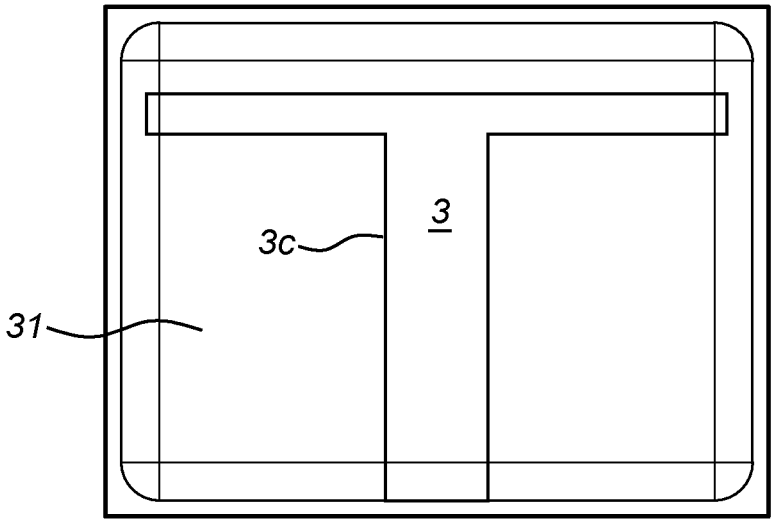

FIG. 11 shows another alternative T-shaped slot 3 delimited by a contour 3*c* and provided on the top metallized layer 31.

The contour of the T-shaped slot 3 in the top metallized layer has the form of a classical capital T, and is composed of two slots of which a first slot forms a horizontally oriented slot of which the middle part is connected to the top end of a second slot which forms a vertically oriented slot, wherein the contours of the first and second slot are each defined by the superformula according to claim 22, and by the additional conditions:

m1=m2=4 n1_i, n2_i, n3_i→∞

Figure 12:
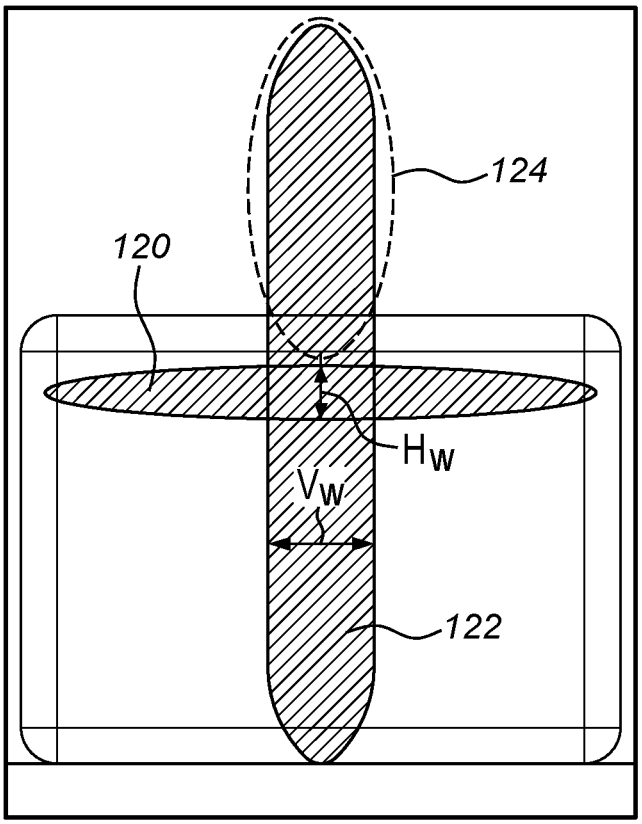
FIG. 12 shows how a preferred T-shaped slot is composed from two combined longitudinal slots.

FIG. 12 shows how the preferred T-shaped slot depicted in FIG. 9, is composed from two combined longitudinal slots 120 and 122, of which the first is horizontally oriented, and the second is vertically oriented. The vertical slot 122 is a truncated form of a complete longitudinal slot as defined by the formula and shown in the picture, and the upper half 124 is not used. The first slot 120 has a cross-directional width halfway its length, denoted as Hw. The second slot 122 has a cross-directional width halfway its length (i.e. halfway the complete length without truncation), denoted as Vw.

Figure 13:
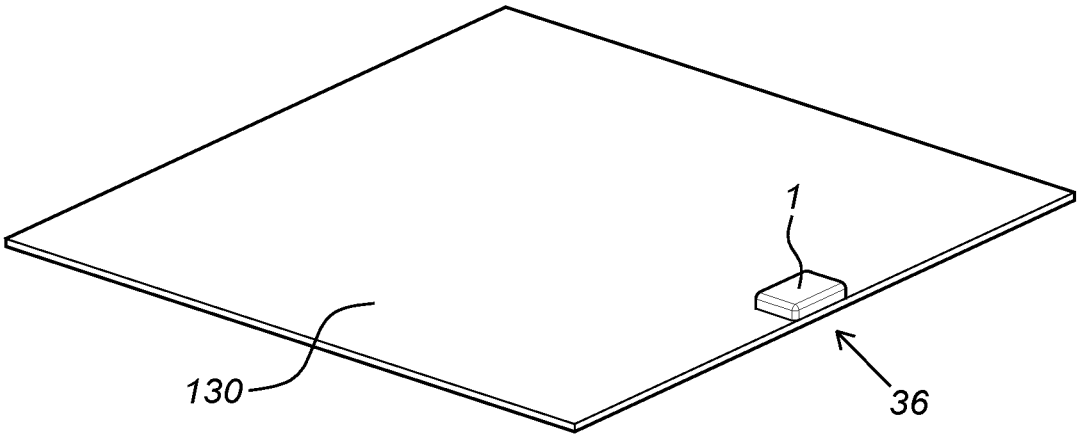
FIG. 13 shows a perspective view of a PCB board provided with an antenna according to the invention.

FIG. 13 shows a perspective view of a PCB board 130 provided at its circumferential side, with an antenna 36 according to the invention. Most of the antenna is not visible as it is fully covered by the block 36 which is provided on the top side of the antenna.

EXAMPLES

Radiation properties of several antennas within the realm of the invention were measured. The antennas measured cover both the first and second types, with various T-shaped slots on the metallized layer.

Group 1; "5G Antenna"

Of the first preferred type of the antenna of the general design given in FIG. 1, which is suitable to be used in the frequency range between 4.9 and 6.0 GHz, three variants were composed, which are also referred to as 5G antennas.

Type 5G.1 "optimal impedance matching configuration"

The general design of FIG. 1 was used, provided with the preferred T-shaped slot according to FIG. 5.

Type 5G.2 "ultra wide band configuration"

The general design of FIG. 1 was used, provided with the preferred T-shaped slot according to FIG. 6.

Type 5G.3 "classical T-shape"

The general design of FIG. 1 was used, provided with a classical T-shaped slot analogous to the one shown in FIG. 11.

The table below shows the radiation properties for the three 5G antenna types.

| Property | 5G.1 | 5G.2 | 5G.3 |
|---|---|---|---|
| Bandwidth (GHz) | 2.09 | 2.52 | 1.67 |
| Fractional BW (%) | 37.5 | 47.4 | 30 |
| Input reflection coefficient | 0.1163 | 0.169 | 0.1863 |
| Peak realized gain (dBi) @5.5 GHz | 3.4 | 3.3 | 3.3 |
| Total efficiency @5.5 GHz | 90.5 | 88.8 | 88.5 |
| Average gain (dBi) @5.5 GHz | −0.4 | −0.5 | −0.5 |
| Peak directivity (dBi) @5.5 GHz | 3.8 | 3.7 | 3.8 |
| OF value (FBW/IRC) | 322 | 280 | 161 |

All the above three 5G antenna types have attractive properties in terms of their radiation properties, and OF value (the ratio of FBW divided by IRC).

Within this group of 5G antennas, the supershaped T-shaped slots of the 5G.1 and 5G.2 configurations are most attractive in terms of OF value.

Group 2, "2G antenna"

Of the second preferred type of the antenna of the general design given in FIG. 2, which is suitable to be used in the frequency range between 2.4 and 2.5 GHz ("2G antennas"), three variants were composed.

Type 2G.1 "optimal impedance matching configuration"

The general design of FIG. 2 was used, provided with the preferred T-shaped slot according to FIG. 9.

Type 2G.2 "broadband configuration"

The general design of FIG. 2 was used, provided with the preferred T-shaped slot according to FIG. 10.

Type 2G.3 "classical T-shape"

The general design of FIG. 2 was used, provided with a classical T-shaped slot according to FIG. 11.

The table below shows the radiation properties for the three 2G antenna types.

| Property | 2G.1 | 2G.2 | 2G.3 |
|---|---|---|---|
| Bandwidth (GHz) | 0.207 | 0.24 | 0.202 |
| Fractional BW (%) | 8.5 | 9.8 | 8.3 |
| Input reflection coefficient | 0.0175 | 0.03 | 0.0192 |
| Peak realized gain (dBi) @2.45 GHz | 2.1 | 2.1 | 2.1 |
| Total efficiency @2.45 GHz | 88 | 86 | 85 |
| Average gain (dBi) @2.45 GHz | −0.7 | −0.7 | −0.7 |

-continued

| Property | 2G.1 | 2G.2 | 2G.3 |
|---|---|---|---|
| Peak directivity (dBi) @2.45 GHz | 2.7 | 2.7 | 2.72 |
| OF value (FBW/IRC) | 486 | 326 | 432 |

All the above three 2G antenna types have attractive properties in terms of their radiation properties, and OF value (the ratio of FBW divided by IRC).

Within this group of 2G antennas, the supershaped T-shaped slot of the 2G.1 configuration is most attractive in terms of OF value.

The invention claimed is:

1. Antenna suitable to be integrated in a printed circuit board, which is an electromagnetically coupled antenna that comprises:

a body of dielectric material of a substantially planar design having a bottom side and top side;

a bottom metallized layer on the bottom side of the body, which layer is provided with a slot;

a top metallized layer on the top side of the body, which layer is provided with a T-shaped slot;

wherein both the above slots, as well as the top and bottom metallized layer surrounding the slots, are provided on symmetrically opposite sides of the body;

wherein electrically conductive strands are provided in the body, which strands extend substantially vertically from the bottom side to the top side, and electrically connect the bottom metallized layer with the top metallized layer;

wherein the strands are disposed in such a way as to collectively form a row that delimits an inner volume of the body;

wherein a feeding line of electrically conductive material is provided inside the body, the feeding line extending in a plane between the bottom side and the top side, wherein the feeding line has a distal section extending within the inner volume of the body delimited by the strands, which distal section has a curled shape in the plane in which it extends.

2. Antenna according to claim 1, further provided with an additional body of dielectric material which covers the T-shaped slot in the top metallized layer.

3. Antenna according to claim 1 wherein the contour of the T-shaped slot in the top metallized layer is composed of two longitudinal slots of which a first slot forms a horizontally oriented slot of which the middle part is connected to the top end of a second slot which forms a vertically oriented slot.

4. Antenna according to claim 1, wherein the distance between adjacent strands in a row is in the range of 1 up to 2 times the thickness of a single strand.

5. Antenna according to claim 1 which is suitable to be used in the frequency range between 4.9 and 6 GHz.

6. Antenna according to claim 5, wherein the bottom metallized layer is provided with a slot having a rectangular, preferably square shape.

7. Antenna according to claim 5, wherein the curled shape is an L-shape, so that the final part of the distal section of the feeding line is oriented substantially orthogonal to a proximal section of the feeding line.

8. Antenna according to claim 7, wherein the L-shape is of a rectangular design, which comprises two longitudinal sections having an orthogonal orientation.

9. Antenna according to claim 8, wherein the first longitudinal section comprises a proximal section of the feeding line, and the second longitudinal section comprises the end part of the distal section of the feeding line, wherein the length of the first longitudinal section (L1) is in the range of 2 to 4 times the length of the second longitudinal section (L2).

10. Antenna according to claim 5 wherein the T-shaped slot comprises a first, horizontally oriented slot having a cross-directional width halfway its length, denoted as Hw, in a range of 0.60 up to 0.90 mm.

11. Antenna according to claim 5 wherein the T-shaped slot comprises a second, vertically oriented slot having a cross-directional width halfway its length, denoted as Vw, in a range of 3.00 mm up to 4.00 mm.

12. Antenna according to claim 5, wherein the contour of the T-shaped slot in the top metallized layer is composed of two slots of which a first slot forms a horizontally oriented slot of which the middle part is connected to the top end of a second slot which forms a vertically oriented slot, wherein the contours of the first and second slot are each defined by the following formula:

$$r_i(\varphi) = \left(\left|\frac{1}{a_i}\cos\frac{m_i}{4}\varphi\right|^{n_{2_i}} + \left|\frac{1}{b_i}\sin\frac{m_i}{4}\varphi\right|^{n_{3_i}}\right)^{-1/n_{1_i}}$$

wherein:

the letter i is an indicator for the formula defining either a first slot (i=1) or a second slot (i=2), n1=n2

ρd(φ) is a curve located in the XY-plane,

φ∈[0,2π) is the angular coordinate ai and bi are scaling factors determining the size of the shape.

13. Antenna according to claim 12, wherein the following parameters are applied:

for i=1 m1=6 n1_1=38 n2_1=19 for i=2 m2=6 n1_2=24 n2_2=47.5 with

L2=3.15 mm

Hw=0.84

Vw=3.38 ai=1 bi=1.

14. Antenna according to claim 12, wherein the following parameters are applied:

for i=1 m1=6 n1_1=38 n2_1=79 for i=2 m2=6 n1_2=24 n2_2=47.5 with

L2=3.15 mm

Hw=0.84

Vw=3.38 ai=1 bi=1.

15. Antenna according to claim 1 which is suitable to be used in the frequency range between 2.4 and 2.5 GHz.

16. Antenna according to claim 15, wherein the bottom metallized layer is provided with a T-shaped slot, which preferably is identical to the slot in the top metallized layer.

17. Antenna according to claim 15, wherein the curled shape of the feeding line is a G-shape, preferably a rectangular G-shape which comprises four or five longitudinal sections of which consecutive sections have an orthogonal orientation.

18. Antenna according to claim 15, wherein the feeding line comprises four or five longitudinal sections of which consecutive sections have an orthogonal orientation, wherein the first longitudinal section comprises a proximal section of the feeding line, and the fourth or fifth longitudinal section constitutes the end part of the distal section of the feeding line, wherein the length of the first longitudinal section (L1) is in the range of 2 to 4 times the length of the second longitudinal section (L2).

19. Antenna according to claim 15 wherein the feeding line has a width in the range of 0.25 to 2.0 mm.

20. Antenna according to claim 15, wherein the T-shaped slot comprises a first, horizontally oriented slot having a cross-directional width halfway its length, denoted as Hw, in a range of 1.20 to 1.40 mm.

21. Antenna according to claim 15, wherein the T-shaped slot comprises a second, vertically oriented slot having a cross-directional width halfway its length, denoted as Vw, in a range of 2.5-3.0 mm.

22. Antenna according to claim 1, wherein the contour of the T-shaped slot in the top metallized layer is composed of two slots of which a first slot forms a horizontally oriented slot of which the middle part is connected to the top end of a second slot which forms a vertically oriented slot, wherein the contours of the first and second slot are each defined by the following formula:

$$r_i(\varphi) = \left(\left|\frac{1}{a_i}\cos\frac{m_i}{4}\varphi\right|^{n_{2_i}} + \left|\frac{1}{b_i}\sin\frac{m_i}{4}\varphi\right|^{n_{3_i}}\right)^{-1/n_{1_i}}$$

wherein:

the letter i is an indicator for the formula defining either a first slot (i=1) or a second slot (i=2), ρd(φ) is a curve located in the XY-plane, φ∈[0,2π) is the angular coordinate, ai and bi are scaling factors determining the size of the shape.

23. Antenna according to claim 22, wherein the following parameters are applied:

for i=1 a1=0.5 b1=4.1 m1=4 n1_1=103 n2_1=33 n3_1=59 for i=2 a2 7.3 b2 3.7 m2=4 n1_2=33 n2_2=48 n3_2=49 with

Hw=1.23

Vw=2.76.

24. Antenna according to claim 22, wherein the following parameters are applied:

for i=1 a1=7.6 b1=3.8 m1=4 n1_1=89.8 n2_1=87 n3_1=88 for i=2 a2=7.7 b2=7.8 m2=4 n1_2=81.9 n2_2=82 n3_2=91 with

Hw=1.38

Vw=2.76.

25. A printed circuit board which is provided with an antenna according to claim 1, wherein a part of the board, and preferably a part of the circumferential edge of the board, constitutes the body of dielectric material of the antenna.

* * * * *